US005114088A

United States Patent [19]

Cardano

[11] Patent Number: 5,114,088

[45] Date of Patent: May 19, 1992

[54] DEVICE FOR THE AUTOMATIC CLAMPING OF A SPOOL OF MATERIAL IN WEB FORM

[75] Inventor: Mario Cardano, Vercelli, Italy

[73] Assignee: Officine Meccaniche Giovanni Cerutti S.P.A., Casale Monferrato, Italy

[21] Appl. No.: 557,415

[22] Filed: Jul. 23, 1990

[30] Foreign Application Priority Data

Aug. 4, 1989 [IT] Italy ..... 21444 A/89

[51] Int. Cl.[5] ..... B65H 49/18

[52] U.S. Cl. ..... 242/68.4; 242/129.6; 403/344

[58] Field of Search ..... 242/68.4, 129.6, 129.62; 279/4; 403/310, 313, 344

[56] References Cited

U.S. PATENT DOCUMENTS 3,117,740 1/1964 Rose ..... 242/68.4
3,606,407 9/1971 Pendergast ..... 242/68.4
3,825,200 7/1974 Puhahn ..... 242/68.4
3,838,829 10/1974 Gotze ..... 242/68.4
4,500,044 2/1985 Schnell ..... 242/68.4
4,527,808 7/1985 Hiestand ..... 242/68.4
4,773,609 9/1988 Steffen et al. ..... 242/68.4
4,838,725 6/1989 Fazis ..... 242/68.4

*Primary Examiner*—Daniel P. Stodola
*Assistant Examiner*—John Q. Nguyen
*Attorney, Agent, or Firm*—Ladas & Parry

[57] ABSTRACT

Device for the automatic clamping of a spool of material in web form, especially for a spool-receiving device of a rotary printing machine, each mounting for receiving the projecting hub of the spool having a shell-shaped lower receptacle for supporting the lower hub part, there being additionally an upper shell-shaped constructional part which is arranged displaceably in the axial direction and which, in the front end position, surrounds the upper hub part and, in the retracted position, releases the upper circumferential part of the hub.

9 Claims, 3 Drawing Sheets

DEVICE FOR THE AUTOMATIC CLAMPING OF A SPOOL OF MATERIAL IN WEB FORM

The above invention relates to a device for the automatic clamping of a spool of material in web form, for example a paper web, which is processed in a rotary printing machine.

At the entrance and exit of rotary printing machines, there is conventionally a respective spool-receiving device which consists essentially of two arms pivotable about a horizontal shaft. Paper spools are mounted rotatably between these arms.

As soon as the paper stock on one spool approaches its end, a pivoting movement of the holding arms of the spool-receiving device through 180° is initiated by the use of known devices. The paper web of the second spool or replacement spool is thereby fed to the printing machine.

After this, the empty spool has to be replaced by a new full spool which then remains in the standby position for the purpose of replacing the spool from which the paper is being drawn off and fed into the printing machine. So that the spool change can be carried out, mechanical clamping devices have become known, and these consist, for example, of a sleeve which is inserted laterally into the core of the spool and which is fastened in this by means of screw connections.

To exchange or mount the spool with a hollow core, it is necessary to carry out the clamping or releasing operations with the aid of large clamping nuts which are tightened or slackened by hand. The clamping and release of the paper spools consequently involves an extremely high outlay in terms of labor and requires a considerable amount of time. At the same time, the exchange of the spools constitutes a dangerous moment for the operating personnel.

Other clamping devices for paper spools have also become known, these having conical mandrels which are actuated by pneumatic cylinder units. In this case, the mandrels are inserted into a tubular spool core, in order, under the effect of the pressure medium, to hold and clamp the spool between the two arms of the spool-changing device.

These clamping devices are not particularly reliable; for example, in the event of a pressure drop, a fluttering of the paper web occurs, with the danger that this fluttering will lead to a tearing of the paper web supplied and to a relatively long machine stoppage time.

Furthermore, there is the danger that, in the event of a pressure drop, the clamping mandrels will come loose from the spool core.

If it is remembered that, in rotary printing machines, the paper spools are also changed several times every hour, it can be appreciated that the attempt to make the spool-changing operation in a rotary printing machine faster and at the same time safer will not only lead to an improvement in the efficiency of the spool-changing device, but simultaneously make it possible to clamp the spools with greater reliability and exchange them at lower cost.

The object of the foregoing invention is to provide a device for the mounting and automatic clamping of a spool for material in web form, which can be processed in a rotary printing machine, and by means of the device provided to carry out the changing of the spools at high speed and with high reliability, in order simultaneously to reduce the times necessary for the spool-changing operation and at the same time afford the greatest possible safety for the operating personnel and ensure a safe clamping of the spool, even in the event of a pressure drop in the hydraulic or pneumatic lines.

According to the invention, this object is achieved in that the mounting for receiving a hub projecting from the spool consists of a shell-shaped receptacle for the lower circumferential part of the hub, and in that, furthermore, there is a further shell-shaped constructional part which is displaceable in the axial direction and which, in the extended position, surrounds the upper circumferential part of the hub, and in the retracted position, releases the upper circumferential part of the hub.

Further advantages of the invention can be taken from the following description, the subclaims and the accompanying drawings.

The subject of the invention is now described in more detail by means of an exemplary embodiment and is illustrated in the accompanying drawings, in which.

Figure 1:
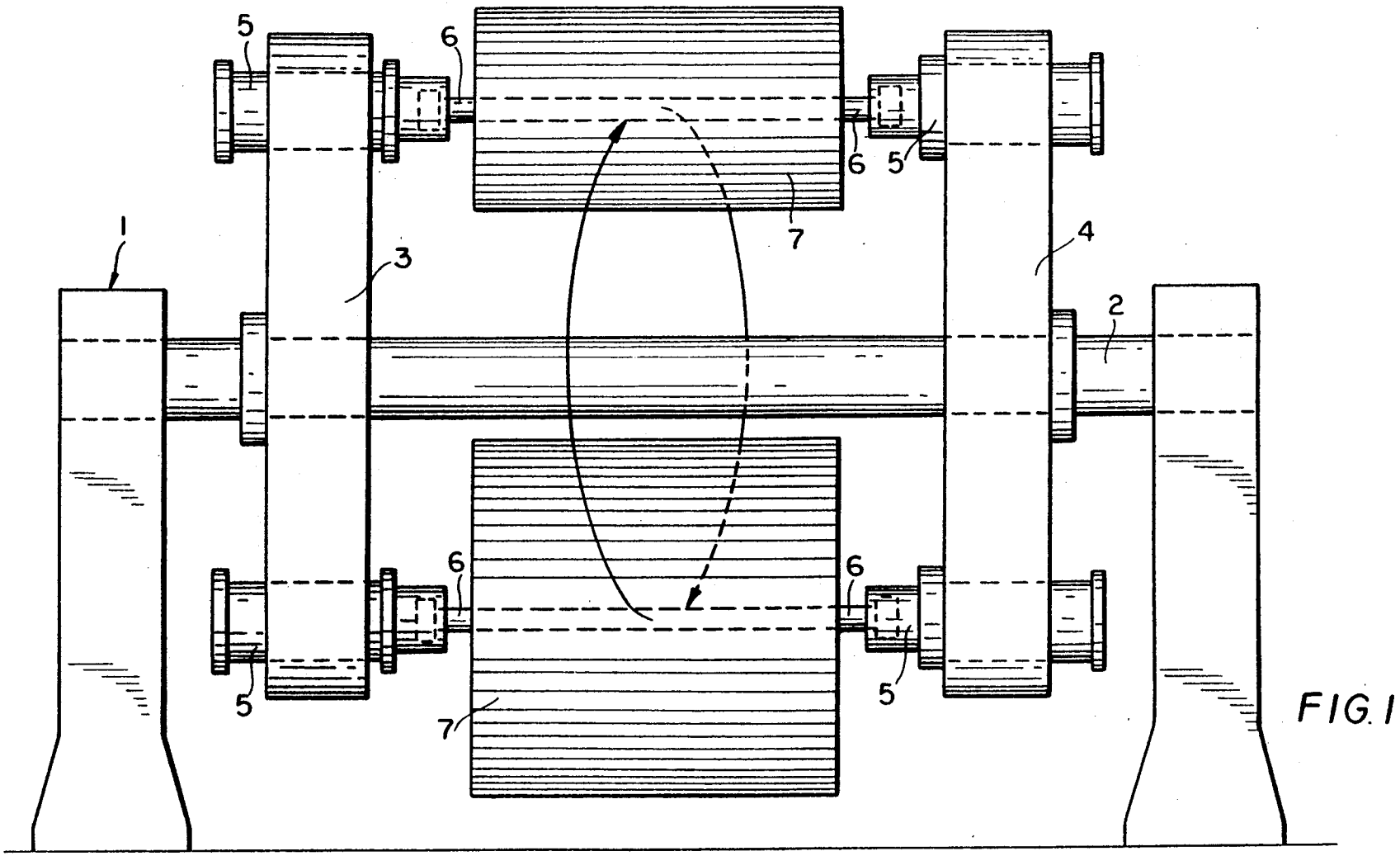
FIG. 1 shows a diagrammatic view of a known spool-changing device for a rotary printing machine.

As can be seen in FIG. 1, the spool-changing device has a horizontally arranged shaft 2 which is equipped with arms 3 and 4 projecting radially from the rotary shaft 2.

Receiving and clamping devices according to the foregoing invention are provided at each end of the arms 3 and 4. These devices are designated as a whole by 5.

The devices 5 receive, by means of hubs 6, spools 7 of the material to be printed on (for example, a paper web).

The arms 3 and 4 are pivoted in a known way, in order to bring a full spool into the unwinding position; in the meantime, an empty spool is replaced by a full spool.

Since the devices for exchanging the spools, both for drawing off the paper web and for inserting full paper spools, are known from the state of the art, there is no need for a detailed description of these devices. It must be remembered, moreover, that the foregoing invention relates solely to the holding and clamping device 5 or the releasing device for the hubs 6 of the spools.

Figure 2:
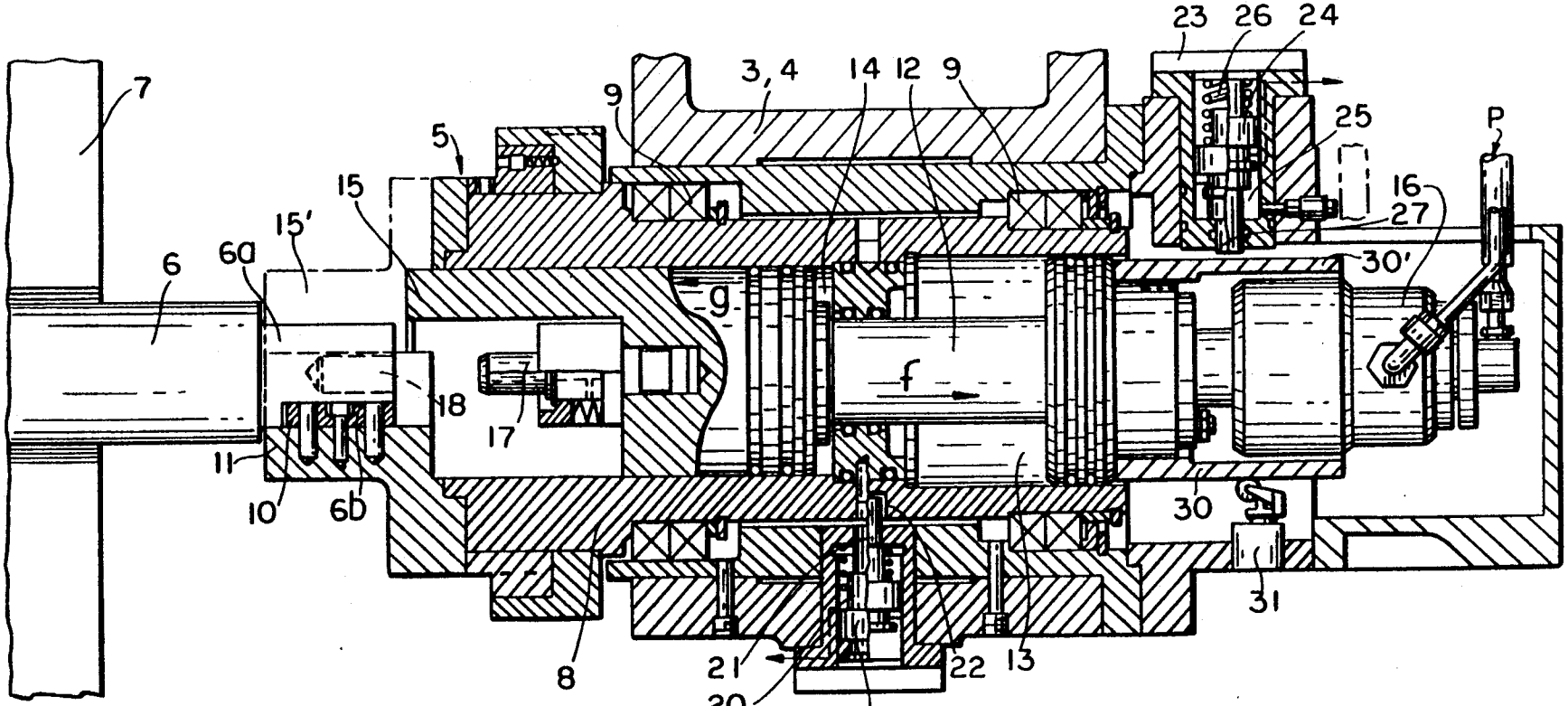
FIG. 2 shows, in section, a detail of the holding device according to the invention for receiving the hub of a spool.
Figure 3:
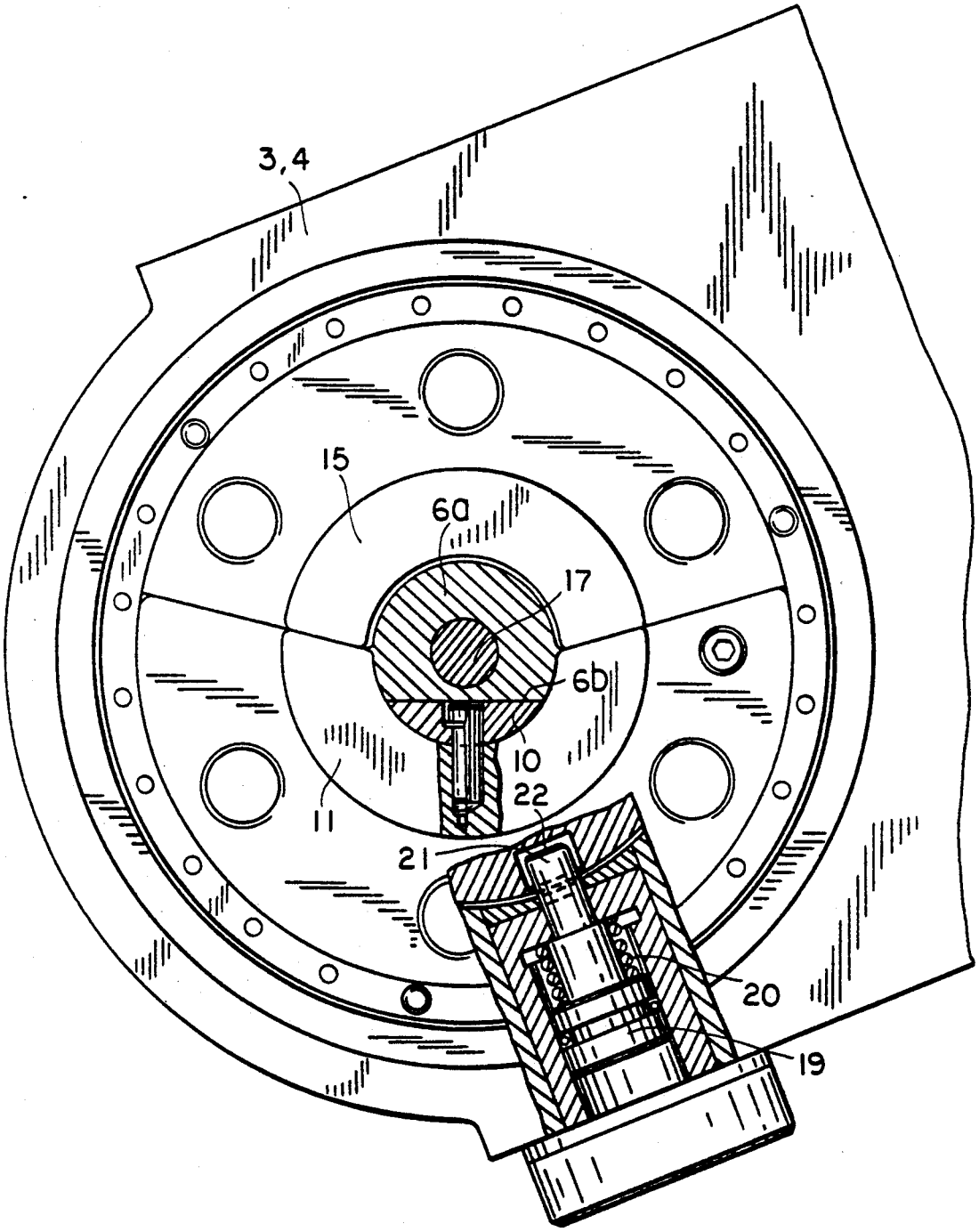
FIG. 3 shows a partially sectional view of the device according to FIG. 2 along the line III—III of FIG. 2.

It can be seen in FIG. 2 that the device 5 for receiving the hub 6 of a spool 7 is located at the end of an arm 3 and 4.

The device 5 consists essentially of a cylindrical tube-like body 8 which receives half-shells 11 and 15. The tube-like body 8 is mounted rotatably at the ends of the arms 3, 4 by means of rolling bearings 9.

The tubular body 8 has, on its front side, a bearing plate 10 which is arranged in a half-shell 11. The half-shell 11 receives the end 6*a* of the hub 6 of the spool 7. Each end 6*a* of the corresponding hub 6 possesses, on its underside, a flat milled-off portion forming a plane 6*b*, by means of which the hub 6 rests on the plate 10.

A double-acting piston 12 is arranged in the tubular body 8. As soon as the chamber 13 is subjected to a pressure medium, a displacement of the piston 12 in the direction of the arrow (f) takes place, whereas when the chamber 14 is so subjected a displacement of the piston in the direction of the arrow (g) occurs. The front part of the piston 12 is designed on top as a half-shell 15. In the position shown in FIG. 2, the half-shell 15 is shifted completely into the interior of the tubular body 8. In contrast, when the chamber 14 is subjected to a pressure medium, the piston 12 and therefore also the half-shell 15 are moved within the direction of the arrow (g), as a result of which the half-shell 15 is extended out of the tubular body 8. The half-shell is moved into the position 15' represented by dot-and-dash lines.

When the half-shell 15 is in the extended state (15'), the upper portion of the hub 6, 6a is likewise covered by the displaceable half-shell 15. Advantageously, the piston/cylinder unit 13, 14 is subjected to compressed air P (via a known rotary connection 16).

The piston 15 receives, on its front side, a centering pin 17 which is arranged fixedly or else can be arranged movably in the axial direction. In this case, the pin 17 is advantageously prestressed by means of a spring. The centering pin 17 is insertable into an axial blind hole 18 fashioned in the end 6a of the hub 6. The advantage of providing the centering pin 17 which can be connected operatively to a centering bore 18 of the hub 6 is to be seen in the fact that, after the closing stroke of the piston 12 has been executed, not only is the end 6a of the hub 6 surrounded by the upper half-shell 15, but the pin 17 also penetrates into the corresponding centering bore 18 of the hub 6, thereby achieving not only a compensation of the position of the spool 7 between two mutually opposite receiving and clamping devices, but at the same time also an additional retention of the spool 7 by the pin 17. Consequently, the total load of the spool 7 does not rest solely on the plate 10 of the lower half-shell 11, but is also absorbed by the centering pin 17 of the upper half-shell 15 and therefore by the tubular body 8.

As can be seen in FIG. 2, a single-acting cylinder 19, that is to say a cylinder loaded in one direction by a spring means 20, is inserted into the arms 3, 4.

The piston/cylinder unit 19 installed in the arms 3 and 4 has a pin 21 which can be connected to a bore 22. The bore 22 is made in the casing or cylinder 8 which is received rotatably by the rolling bearing 9. The bore 22 is so arranged in the rotably mounted cylinder 8 that, with the pin 21 introduced into the bore 22, the lower shell 11 and the plate 10 are arranged exactly in a horizontal position, in order to receive the milled end 6b of the hub 6, 6a on the horizontally arranged bearing plate 10.

To prevent the possibility that the pin 21 will enter the bore inadvertently, inside the piston/cylinder unit 19 there is a spring 20 which, in the absence of pressure medium, displaces the piston 19 into its position of rest, that is to say into a position in which the pin 21 is not connected operatively to the bore 22 of the cylinder 8. Only during the changing of the spool is a pressure medium, for example compressed air, fed to the piston/-cylinder unit 19, in order to effect a displacement of the pin 21 together with a compression of the spring 20 and cause the pin 21 to enter the bore 22. The lower half-shell is thus locked in the desired position and fixed in a position in which it is possible to receive the flattened end of the hub 6 of the spool 7 so that it rests flush.

Also on the rear side of the device 5 there is an additional cylinder 23 receiving a piston 24. The cylinder 23 is likewise designed as a single-acting cylinder. On one side there is a chamber 25 for the supply of a pressure medium, and the second chamber of the cylinder 23 receives a spring 26 which influences the piston 23. The piston 23, on its front side, has a pin 27 which interacts with an end piece 30' of a tube-like extension 30 of the main piston 12.

By influencing the chamber 25 by means of a pressure medium, the pin 27 is moved back and the spring 26 is compressed by the piston 23. It is therefore possible for the upper locking shell 15 to execute a free displacement movement in the direction of the arrow (f). If, in contrast, the pressure medium is absent, the pin 27 is extended as a result of the spring effect 26 and is positioned in conformity with the end 30' of the constructional part 30. The piston 12 and the upper shell 15 are thus prevented from executing a displacement movement, with the result that the spool 7 and the associated hub 6, 6a reliably remain locked in the device 1, even if there is a sudden pressure reduction, for example in the chamber 14.

A pneumatic breaker 31 is provided at the end of the constructional parts 30, 30' of the piston 12. When the pneumatic breaker 31 connected to a control device (not shown) is actuated by the body 30 of the extension of the piston 12, the piston 19 cannot be actuated. It is therefore impossible for the pin 21 to be extended. If, in contrast, the functioning of the switch 31 is interrupted as a result of a complete extending movement of the piston 12 in the direction of the arrow (g), a control signal is generated, which makes it possible to actuate the piston 19 and introduce the pin 21 into the bore 22 of the tubular body 8, in order to fix the body 8 in the desired position.

As soon as the breaker 31 is rendered inoperative (since it is not actuated by the end piece 30), a signal is generated, for example by an electrical pressure switch, and is used to initiate the rotational movement of the shaft and the pivoting movement of the arms 3, 4.

In the present example, a pneumatic piston 12 for driving the upper shell 15 has been described. Other drive means, for example electric drives, can also be used, without thereby departing from the scope of the invention.

The mode of operation of the device according to the invention is as follows:

As soon as the control unit (not shown) of the machine indicates that a spool 7, the paper stock of which is approaching its end, is to be exchanged for a full spool, the shaft 6 and therefore the cylindrical body 8 are slowly set in rotational movement, in order to allow an operative connection between the pin 21 of the piston 19 and the bore 22 fashioned in the extension 8. In this position, the plate 10 of the lower shell 11 is in an exactly horizontal position and the shaft 6 is prevented from executing a rotational movement.

After this, the pin 27 of the piston 24 is driven in such a way that the end piece 30' of the piston 12 assumes a free position.

Thereafter, the piston 12 is retracted (f), with the result that the upper shell 15 exposes the end 6a of the hub 6 and makes it possible to raise the empty spool 7 together with the hub 6, in order to extract the end 6a of the spool from the bearing shell 11. As a result of retraction, at, the same time the switch 31 is actuated by the end 30, 30' of the piston 12 and an electrical signal is generated, indicating that the mounting 5 is opened. After a new spool 7, the hub 6, 6a of which once again fills the half-shell 11, has been loaded, the piston 12 is moved in the direction of the arrow (g) again. During the closing movement, the pin 17 enters the bore 18 of the hub 6a, and at the same time the upper shell 15 is displaced into the position represented by dot-and-dash lines 15'. The hub 6, 6*a* is thereby locked securely in the mounting 5. The executed locking is indicated by the switch 31, since, in the locked position of the mounting 5, no control signal is transmitted by the switch which is not actuated by the construction part 30, 30'. Subsequently, the piston 24 and its pin 27 are actuated in such a way that the end of the piston 30 is locked. This prevents the possibility that the piston 12 will inadvertently initiate an opening movement in the direction of the arrow (f).

Thereafter, the bore 22 is released by the pin 21, in that the piston 19 is correspondingly loaded and displaced, thereby making it possible to set the tubular body 8 and therefore the newly inserted spool in rotational movement.

The piston 24 is especially advantageously loaded by a spring 26 which tends to maintain the operative connection between the pin 27 and the end piece 30' of the piston 12.

The piston 19 is loaded by a spring 20 in such a way that the pin 21 is kept away from the bore 22.

This constructional solution represents a further safety measure, by means of which the device 5 reliably remains closed as a result of the effect of the spring 26, even when there is a pressure drop in the pressure medium P. Reliable locking between the pin 27 and the end piece 30' is thereby ensured. In contrast, the spring 20 endeavours to keep the pin 21 away from the bore 22. This operative connection can be made solely by means of the pressure medium.

What is claimed is:

1. A device for the automatic locking of a hub projecting from a spool of material in web form, comprising a lower shell-shaped receptacle for supporting a lower circumferential part of the hub, and an upper shell part which is axially displaceable relative to said lower shell-shaped receptacle so that in an extended position said upper shell part surrounds an upper circumferential part of the hub and, in a retracted position, permits the hub to be removed from the device.

2. The device as claimed in claim 1, further comprising a plane bearing plate which is positioned on an inner portion of the lower shell upon which rests a plane portion of an end piece of the hub.

3. The device as claimed in claim 2, further comprising a cylindrical body, for receiving the upper and lower shells, which is mounted rotatably on free ends of arms that engage the device.

4. The device as claimed in claim 3, further comprising an axially moveable piston which is positioned within the cylindrical body and engages the upper shell.

5. The device as claimed in claim 4, wherein a rear end of the cylindrical body has a rotatable coupling for feeding a pressurized medium to chambers defined inside the cylindrical body.

6. The device as claimed in claim 5, further comprising a spring-loaded centering pin, on a front end of the axially moveable piston, which is engageable with a centering bore in the end of the hub.

7. The device as claimed in claim 6, further comprising, in at least one of said arms, a first piston positioned so that a pin, connected to said first piston unit, can engage a bore in the cylindrical body.

8. The device as claimed in claim 7, further comprising a second piston unit positioned by the rear end, having a pin extending therefrom that can engage the axially moveable piston.

9. The device as claimed in claim 8, further comprising a switch, adjacent the end of the axially moveable piston, which detects the extended position and the retracted position of the axially moveable piston and therefore the locking and opening of the upper shell.

* * * * *